US012752891B2

(12) United States Patent
Kim et al.

(10) Patent No.: US 12,752,891 B2
(45) Date of Patent: Oct. 6, 2026

(54) LIFE-SAVING ROBOT

(71) Applicants: HYUNDAI MOTOR COMPANY, Seoul (KR); KIA CORPORATION, Seoul (KR)

(72) Inventors: Sung Jun Kim, Hwaseong-si (KR); Dong Hoon Oh, Hwaseong-si (KR); Jin Wook Kim, Hwaseong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 173 days.

(21) Appl. No.: 18/889,036

(22) Filed: Sep. 18, 2024

(65) Prior Publication Data

US 2025/0100658 A1 Mar. 27, 2025

(30) Foreign Application Priority Data

Sep. 21, 2023 (KR) ..... 10-2023-0126530
Jun. 24, 2024 (KR) ..... 10-2024-0082147

(51) Int. Cl.
*B63C 9/03* (2006.01)
*B63C 9/00* (2006.01)

(52) U.S. Cl.
CPC ..... *B63C 9/03* (2013.01); *B63C 2009/0035* (2013.01)

(58) Field of Classification Search
CPC ..... B63C 9/03; B63C 2009/0035; B63C 9/00; B63C 9/02; B63B 2035/007; B63B 35/00; B63B 2035/008; B63B 2035/006; B63B 22/18; B63B 2035/005
See application file for complete search history.

(56) References Cited

U.S. PATENT DOCUMENTS

| | | | | |
|---|---|---|---|---|
| 8,882,555 | B2 * | 11/2014 | Mulligan | B63C 9/00 441/80 |
| 9,096,106 | B2 * | 8/2015 | Hanson | B60F 5/00 |
| 11,136,097 | B2 * | 10/2021 | Sandberg | B63B 45/00 |
| 11,518,485 | B2 * | 12/2022 | Mitev | B63C 9/08 |
| 12,057,000 | B2 * | 8/2024 | Sandberg | G08B 21/043 |
| 12,434,800 | B2 * | 10/2025 | Anderson | B63C 9/02 |
| 2019/0329849 | A1 * | 10/2019 | Ko | B63C 9/20 |

FOREIGN PATENT DOCUMENTS

| | | | | |
|---|---|---|---|---|
| CN | 104015896 A | * | 9/2014 | |
| CN | 205554536 U | * | 9/2016 | |
| CN | 107521635 A | * | 12/2017 | B63H 21/38 |
| WO | WO-2012139044 A1 | * | 10/2012 | B63B 35/00 |

* cited by examiner

*Primary Examiner* — Eldon T Brockman
(74) *Attorney, Agent, or Firm* — Fish & Richardson P.C.

(57) ABSTRACT

A life-saving robot includes a housing having a round ring shape, a buoyancy generator disposed at an upper portion of the housing, a thrust generator disposed at a lower portion of the housing and configured to provide propulsive force, a driver configured to provide power to the thrust generator, and a guard portion that is disposed at the lower portion of the housing and covers the thrust generator. An exterior of the life-saving robot is substantially spherical and defined by a combination of the buoyancy generator, the housing, and the guard portion.

20 Claims, 16 Drawing Sheets

LIFE-SAVING ROBOT

CROSS-REFERENCE TO RELATED APPLICATIONS

This application claims benefit of priority to Korean Patent Application No. 10-2023-0126530, filed on Sep. 21, 2023, and Korean Patent Application No. 10-2024-0082147, filed on Jun. 24, 2024, in the Korean Intellectual Property Office, the disclosures of which are incorporated herein by reference in their entirety.

TECHNICAL FIELD

The present disclosure relates to a life-saving robot.

BACKGROUND

A water rescue robot can refer to a type of intelligent control life-saving device and may be used in rescue, fire control, marine affairs, coast guard, fleet logistics departments, and other civil water emergency situations.

For instance, underwater rescue robots may be launched from ships, shore installations or airplanes and may have a large life-saving range, long communication distance, remote control of driving direction, remote rescue, intelligent direction correction, simple operation, and two-way function. In some cases, the front and rear running, quick rescue intelligent, life-saving path on the water may be accurately controlled.

In some cases, the underwater rescue robot may rescue three to four people at the same time, may have stable running speed and flexible rotation even in the water, and may not need to be dragged by floating ropes or manpower. The underwater rescue robot may accurately reach a target location, and rapid rescue may be possible even in large winds and waves.

In some cases, underwater rescue robots may be generally manufactured to have a tube shape or a boat shape in consideration of underwater running performance, where the structure may be inconvenient to store and manage due to shape limitations thereof. In some cases, the process of ejecting an underwater rescue robot in an actual emergency situation may not be easy.

In some cases, due to the shape of an underwater rescue robot, it may not be easy to provide a device to store or charge the robot, and a structure to launch the underwater rescue robot from a storage station may not be provided. Therefore, rapid launch may be difficult.

SUMMARY

The present disclosure describes a life-saving robot with a simple structure that is easy to store and charge and that has a structure allowing for ejection thereof rapidly in emergency situations.

In addition, an aspect of the present disclosure is to provide a docking station storing and charging a life-saving robot and having a structure capable of ejecting the life-saving robot in an emergency.

According to one aspect of the subject matter of the present application, a life-saving robot includes a housing having a round ring shape; a buoyancy generator disposed at an upper portion of the housing; a thrust generator disposed at a lower portion of the housing and providing propulsive force; a driver providing power to the thrust generator; and a guard portion disposed at the lower portion of the housing and covering the thrust generator. An exterior of a combination of the buoyancy generator, the housing and the guard portion is substantially spherical.

The housing may have a handle protruding externally.

The handle may be provided in a square shape with substantially rounded corners along an edge of the housing.

The buoyancy generator may have an air capsule provided therein, and the air capsule may be provided to correspond to a shape of the buoyancy generator.

The buoyancy generator may be watertightly coupled to the housing.

The driver may include a driving motor driving the thrust generator; and a battery providing power to the driving motor.

The thrust generator may be a propeller.

The buoyancy generator may include a charging module, and the charging module may be connected to the battery. The guard portion may be a mesh-shaped frame.

The housing may be provided with a communication interface and a Global Positioning System (GPS) unit.

BRIEF DESCRIPTION OF DRAWINGS

The above and other aspects, features, and advantages of the present disclosure will be more clearly understood from the following detailed description, taken in conjunction with the accompanying drawings.

DETAILED DESCRIPTION

Figure 1:
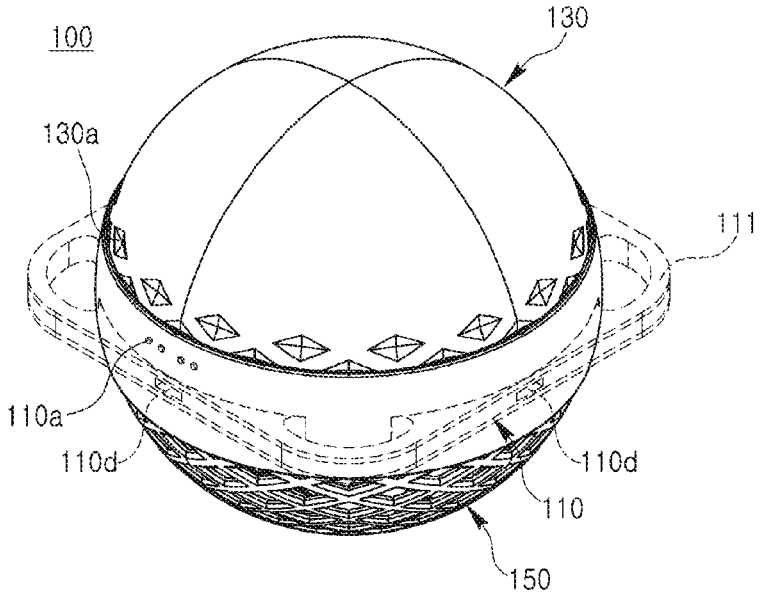
FIG. 1 is a perspective view showing an example of a life-saving robot.

Since the present disclosure may make various changes and have various embodiments, specific embodiments will be illustrated in the drawings and described in detail. However, this is not intended to limit the present disclosure to specific embodiments, and should be understood to include all changes, equivalents, and substitutes included in the spirit and technical scope of the present disclosure.

In this specification, a vehicle refers to a variety of vehicles that move transported objects, such as people, animals, or goods, from a starting point to a destination. These vehicles are not limited to vehicles that run on roads or tracks. In addition, vehicles are not limited to those only using fossil fuels such as gasoline, but also include those using secondary batteries using electricity stored in batteries or the like, and those using future fuels such as hydrogen.

In the description below, the terms "anterior," "posterior," "lateral," "front," "back," "up/down," "above," "upper," "top," "below," "lower," "bottom," "left/right," and the like, used in relation to direction, are defined based on the vehicle or body of the car. In addition, terms such as first, second and the like may be used to describe various components, but these components are not limited in order, size, location, or importance by terms such as first, second and the like, and are named only for the purpose of distinguishing one component from other components.

Hereinafter, one or more implementations of life-saving apparatuses and system will be described in more detail with reference to the attached drawings.

In some implementations, the life-saving apparatus may be a life-saving robot 100. For example, the life-saving robot 100 may have a substantially spherical shape as a whole, and may be provided with a handle on the edge to facilitate rescue of a drowning person.

In some examples, the life-saving robot 100 may have a simple structure in a spherical shape, be easy to store and charge, and be able to launch rapidly in an emergency situation. In some implementations, the life-saving robot 100 may have a dedicated docking station 300, where the docking station 300 may have a structure that stores and charges the life-saving robot 100 and is capable of ejecting the life-saving robot 100 in an emergency.

In some implementations, referring to FIGS. 1 to 4, the life-saving robot 100 may include a housing 110 forming a substantially spherical appearance, a buoyancy generator 130, and a guard portion 150. Additionally, a thrust generator 140 that provides propulsion to the life-saving robot 100 may be provided inside the guard portion 150.

In more detail, the life-saving robot 100 may include a round ring-shaped housing 110, a buoyancy generator 130 provided on the upper portion of the housing 110, a thrust generator 140 provided on the lower portion of the housing 110 and providing propulsion, a driver 120 provided in the housing 110 and providing power to the thrust generator 140, and a guard portion 150 provided on the lower portion of the housing 110 and covering the thrust generator 140. In addition, the exterior of the buoyancy generator 130, housing 110, and guard portion 150 combined may be substantially spherical.

In some implementations, for convenience of use by the drowning person, a handle 111 may be provided on the edge of the housing 110. Hereinafter, for convenience of explanation, the structure in which the handle 111 is provided on the edge of the housing 110 will be described as an example.

The housing 110 may have a round ring shape. The housing 110 may serve as an equator where the upper hemisphere and the lower hemisphere are respectively combined in the life-saving robot 100, which has an overall approximately spherical shape. As will be explained below, the buoyancy generator 13 may be coupled to the upper hemisphere, and the guard portion 150 may be coupled to the lower hemisphere.

The housing 110 may be provided with a handle 111 that may be grasped by a person in danger of drowning along a round edge. The handle 111 may be provided in a square shape with rounded corners substantially along the edge of the housing 110.

A charging indicator **110*a* may be provided on the outer surface of the housing 110 to show the charging state of the battery 123 provided inside. The charging indicator 110*a*** may be provided in various structures, such as LED lights.

The housing 110 may be provided with a substrate 113 forming a boundary between the upper and lower hemispheres, and the substrate 113 may enable the upper and lower hemispheres to be airtightly discriminated from each other, for example, to prevent water from passing therethrough.

Various electrical components may be provided on the upper hemisphere side of the substrate 113. For example, a battery 123, a communication interface 114 (e.g., antenna), a GPS module 115, and the like may be provided. In some examples, a control unit 117 for controlling the life-saving robot 100 may also be provided. For example, the control unit 117 may include a controller, an electric circuit, a processor, or the like.

The life-saving robot 100 may be driven under the control of the control unit 117.

Under the control of the control unit 117, the life-saving robot 100 is capable of mutual communication between a plurality of life-saving 100 through the robots communication interface 114, and is capable of platooning driving according to a set arrangement. In some examples, the life-saving robot 100 may communicate with a headquarters (for example, the ship or aircraft that ejects the life-saving robot) through the communication interface 114. In addition, since the GPS module 115 is provided, people at risk of drowning in a specific location may be rescued by moving according to the location coordinates input to the GPS module 115.

A thrust generator 140 may be coupled to the lower hemisphere side of the substrate 113. The thrust generator 140 includes a propeller 141 and may include a propeller duct 143 surrounding the propeller 141 to protect the propeller 141 and facilitate installation.

Additionally, the driver 120 driving the propeller 141 may include a rotation motor 121 and a battery 123. The rotation motor 121 may be a servomotor.

The battery 123 may be provided on the upper hemisphere side of the substrate 113 so as not to contact water, and the rotation motor 121 may be provided on the lower hemisphere side of the substrate 113 to directly drive the propeller 141, and in detail, may be fixedly installed inside the propeller duct 143.

The battery 123 and the rotation motor 121 may be connected to each other through electrical wiring, and the driving of the rotation motor 121 may be controlled according to commands from the control unit 117.

In some implementations, at least two rotation motors 121 may be provided on the left and right, and the left and right rotation motors 121 may be individually driven according to commands from the control unit 117, and thus various drives such as forward driving, backward driving, direction change, and turning may be possible.

The buoyancy generator 130 may be coupled to the upper portion of the housing 110, for example, the upper hemisphere side. Since various electrical components are provided on the upper hemisphere of the housing 110, the buoyancy generator 130 may be watertightly coupled to the housing 110.

The buoyancy generator 130 has a substantially hemispherical upper cover 131, and the upper cover 131 may be watertightly coupled to the housing 110. The upper cover 131 is watertightly coupled to the housing 110 and may protect the electrical components provided on the upper hemisphere of the housing 110 from getting wet.

A diamond pattern 130*a* may be applied to the outer surface of the upper cover 131. The diamond pattern 130*a* may function to ensure that when the life-saving robot 100 (for example, autonomous buoy) is in the sea, sunlight is reflected from various reflective surfaces and is clearly visible.

The upper cover 131 may be coupled to the housing 110 with a hook coupling structure and then watertightly coupled by additionally adding a heat coupling method.

Additionally, the upper cover 131 may be coupled to the housing 110 with a hook coupling structure, and a sealing 119 may be interposed between the upper cover 131 and the housing 110. The sealing 119 may be made of rubber or silicone, and may be provided in a round ring shape to correspond to the shape of the part where the upper cover 131 is in close contact with the housing 110.

For hook connection, the upper cover 131 may be provided with at least two hooks 133 along the lower edge, and the housing 110 may be provided with hook grooves 110*b* along the upper edge corresponding to the number and position of the hooks 133.

Figure 2:
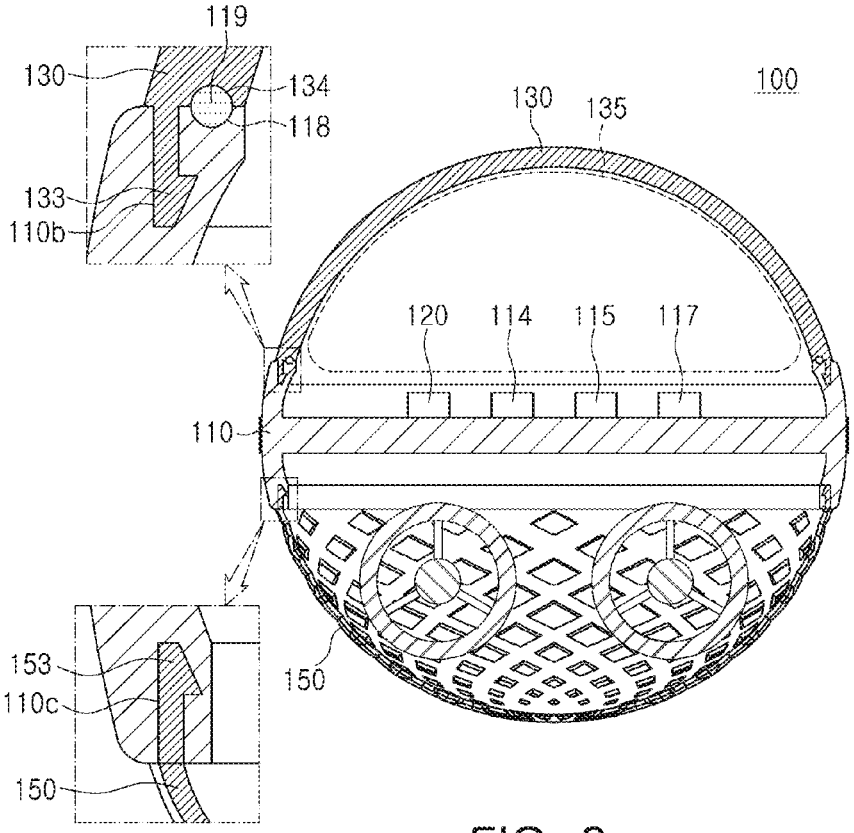
FIG. 2 is a schematic cross-sectional view showing an example of the life-saving robot.
Figure 3:
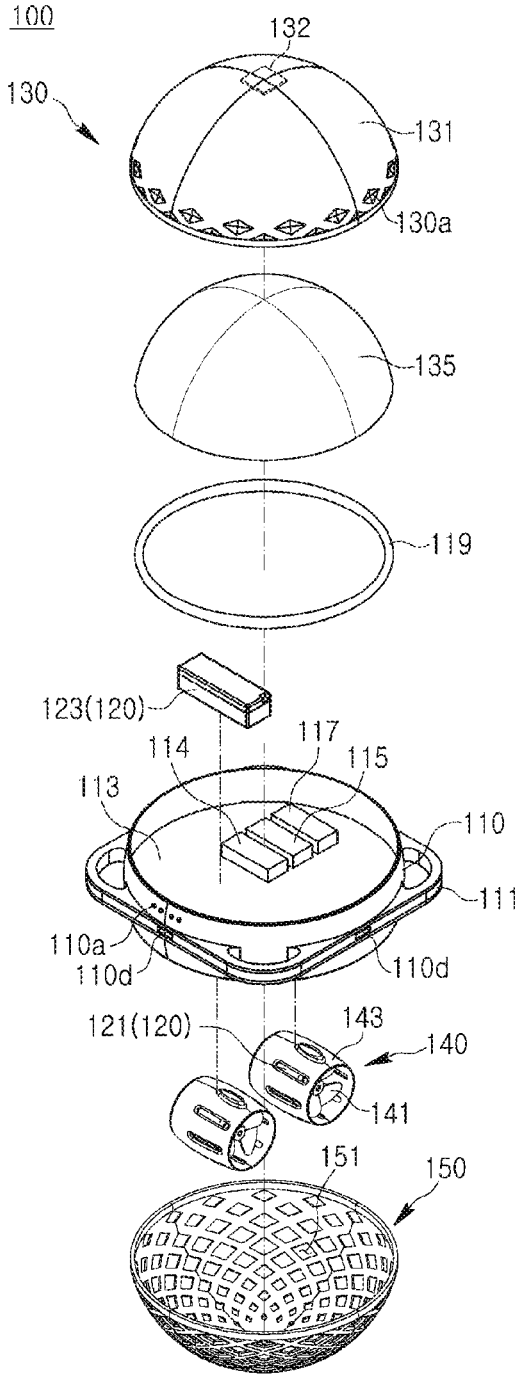
FIG. 3 is an exploded perspective view showing an example of the life-saving robot.
Figure 4:
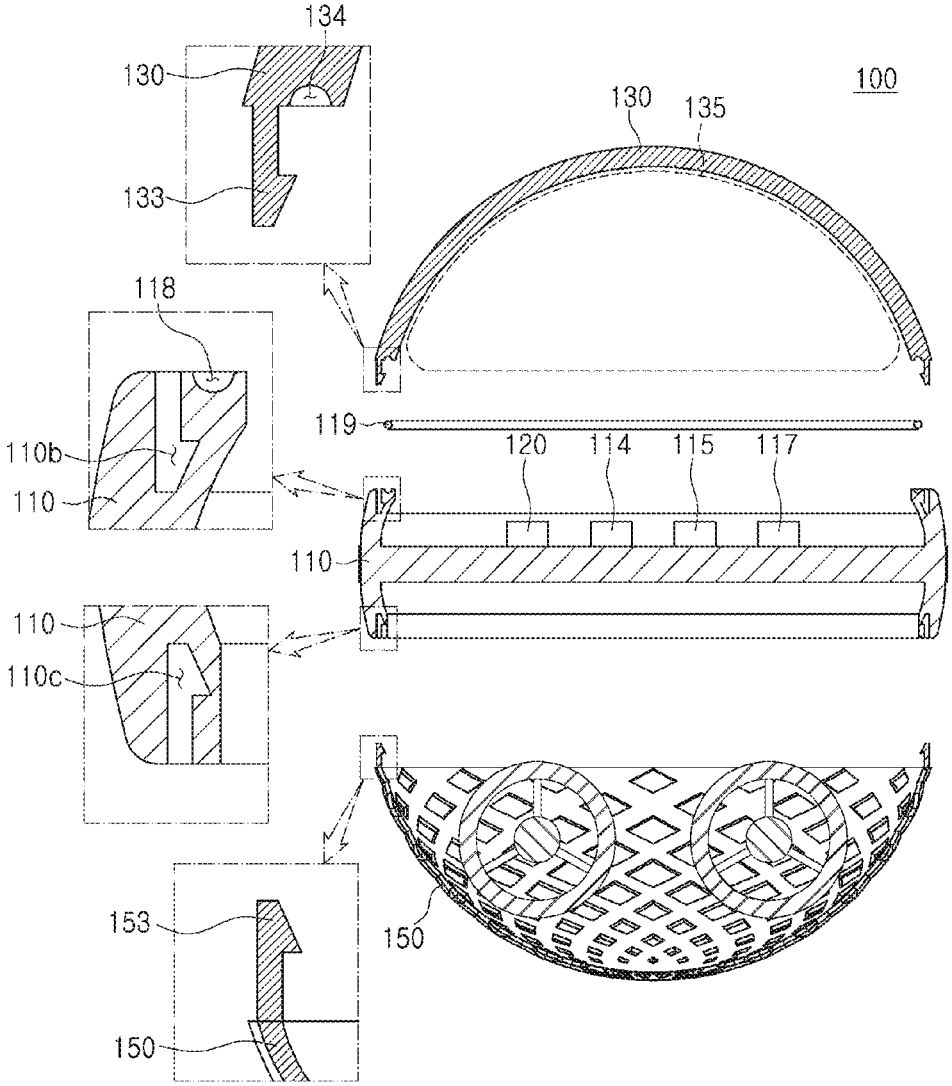
FIG. 4 is a reference cross-sectional view illustrating a combined structure of the life-saving robot.

As illustrated in FIG. 2, the sealing 119 may be inserted into the sealing grooves 134 and 118 provided in a ring shape along the lower edge of the upper cover 131 and the upper edge of the housing 110.

The buoyancy generator 130 is a main part forming buoyancy and may include an air capsule 135 provided inside the upper cover 131. The air capsule 135 may be provided in an approximately hemispherical shape corresponding to the inner surface of the upper cover 131 to fill inside the upper cover 131.

The air capsule 135 may function like a float or a tube and may be filled with gas to create buoyancy inside. Additionally, the air capsule 135 may be attached and fixed to the inside of the upper cover 131 using an adhesive.

A charging module 132 may be provided on the top portion of an inner surface of the upper cover 131. The charging module 132 may be a module capable of wired or wireless charging. As will be described below, the life-saving robot 100 may be stored in the docking station 300 and may be charged while stored.

To this end, when the life-saving robot 100 is inserted into the docking station 300, the top portion of the upper cover 131 is automatically set to be located at the uppermost position, and when the cover of the docking station 300 is closed, the charging module 359 provided inside the cover of the docking station 300 and the terminal of the charging module 132 of the life-saving robot 100 may contact or charge the battery 123 using a wireless charging method. In some examples, the charging module 132 may be electrically/controllably connected to the battery 123.

The life-saving robot 100 may be inserted into the docking portion 340 of the docking station 300. In addition, the docking portion 340 is provided to be rotatable, so that when the cover 350 is opened or closed to insert the life-saving robot 100, the docking portion 340 may also be automatically rotated.

Accordingly, the life-saving robot 100 may be stored and fixed in the docking portion 340, and to this end, a fixing hook groove 110*d* may be provided on the edge of the housing 110 of the life-saving robot 100, and a fixing hook 343 may be provided in the docking portion 340.

At least one fixed hook groove 110*d* may be provided on the edge of the housing 110 of the life-saving robot 100, and for convenience of storage of the life-saving robot 100, four fixed hook grooves may be provided at 90-degree intervals along the edge of the housing 110 to enable storage without considering directionality.

The docking portion 340 may be provided with a fixing hook 343. The fixing hook 343 may lock and secure the life-saving robot 100 inserted into the docking portion 340.

The docking portion 340 may be provided to be rotatable about the rotation axis (RX), and a hooking portion 343*a* that is inserted into the hollow insertion portion 341 of the life-saving robot 100 and locks the life-saving robot (100), and the opposite side of the hooking portion 343*a* centered on the rotation axis (RX), may be supported by a support spring 343*b*, thereby maintaining the locking state.

In addition, when the life-saving robot 100 is inserted into the hollow insertion portion 341 of the docking portion 340, the hook-shaped hooking portion 343*a* is inserted into the fixing hook groove 110*d*, so that the life-saving robot 100 may be fixed to the docking portion 340 by hooking.

In more detail, when the life-saving robot 100 is inserted into the hollow insertion portion 341 of the docking portion 340, as the support spring (343*b*) pushing the fixed hook (343) is pushed, the hooking portion (343*a*) may be pushed and may then return to be caught in the fixed hook groove (110*d*), and as a result, the life-saving robot 100 may be fixed to the docking portion 340.

In addition, the fixing hook 343 may be connected to the wire 343*c*, and the wire 343*c* is connected to the rotating shaft 340*a* of the docking portion 340, so that when the rotating shaft 340*a* rotates, the wire 343*c* is wound around the rotating shaft 340*a* and is pulled to push the fixing hook 343. As a result, the life-saving robot 100 may be provided with a structure in which it is automatically separated from the docking portion 340.

In some implementations, the fixing hook 343 of the docking portion 340 may have a structure in which the fixing hook 343 is pushed or returned to the original state thereof by being linked to a separate drive motor. Alternatively, the fixing hook 343 may be provided with an unhook inclined portion 343*d* whose end is cut slanted in the hooking portion 343*a*. When the docking portion 340 rotates so that the life-saving robot 100 is ejected from the docking portion 340, the fixed hook 343 is pushed by the self-weight of the life-saving robot 100 and may be automatically separated.

A guard portion 150 may be coupled to the lower portion of the housing 110, for example, the lower hemisphere side. The thrust generator 140 is provided on the lower hemisphere of the housing 110, and may have a structure that allows water to flow in and out, and thus, waterproofing is not provided for the guard portion 150.

The guard portion 150 may be provided in a substantially hemispherical lower cover shape, and the guard portion 150 may define a plurality of holes 151 so that water may easily flow in and out while protecting the drowning person. For example, the hole 151 provided in the guard portion 150 may have a diamond shape. In some examples, the guard portion 150 may be provided in a mesh shape, and the hole 151 formed by the mesh shape may be diamond shaped.

The guard portion 150 may be coupled to the housing 110 with a hook coupling structure.

For hook connection, the guard portion 150 may be provided with at least two hooks 133 along the upper edge, and the housing 110 may be provided with hook grooves 110*c* corresponding to the number and position of the hooks 133 along the lower edge.

Figure 5:
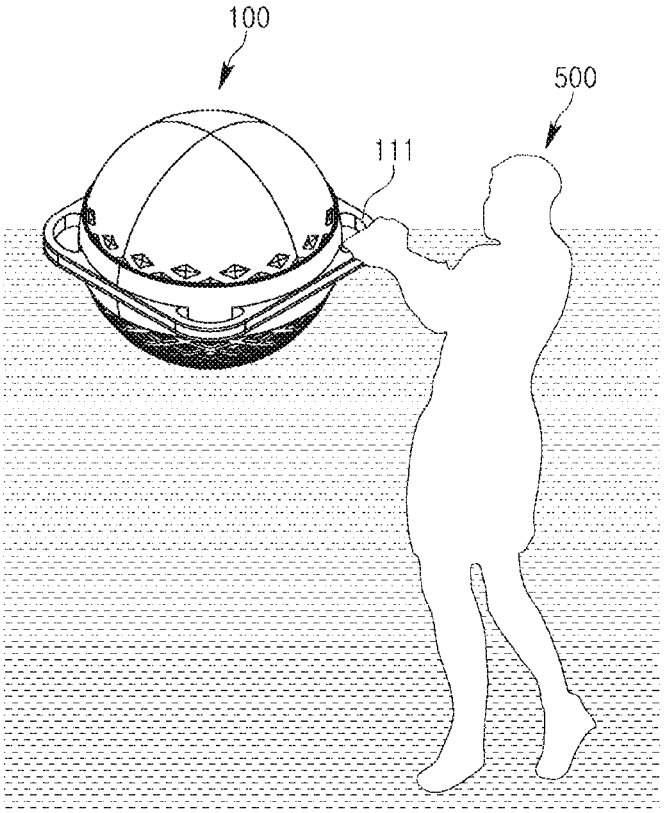
FIG. 5 is a diagram illustrating an example use of a life-saving robot.
Figure 6A:
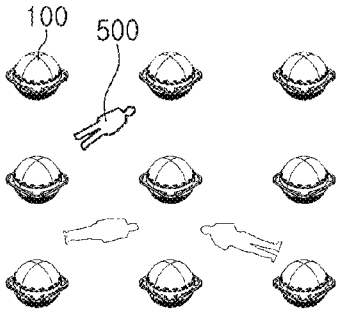
FIGS. 6A to 6C are diagrams illustrating example uses of platooning driving of life-saving robots.
Figure 6B:
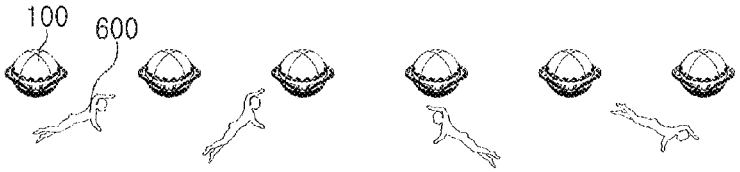
Figure 6C:
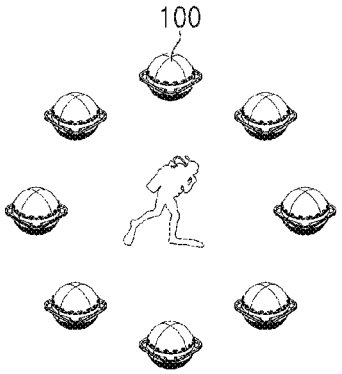

FIG. 5 is a diagram illustrating the use of a life-saving robot, and FIGS. 6A to 6C are reference diagrams illustrating the use of platooning driving of a life-saving robot.

Referring to FIG. 5, the life-saving robot 100 is capable of autonomous driving to find the drowning person 500, and when the life-saving robot 100 approaches, the drowning person 500 may hold the handle 111 and maintain the head above the surface.

In some implementations, referring to FIGS. 6A to 6C, a system may include a plurality of life-saving robots 100, where the life-saving robot 100 has the effect of efficiently and smoothly searching for and rescuing the drowning person 500 through platooning autonomous driving. The detailed effects of each may be additionally illustrated in the three platooning autonomous driving scenarios.

For example, referring to FIG. 6A, in a detection mode, the system including the plurality of life-saving robots 100 may be configured to be disposed in a checkerboard arrangement. A detailed search or wide-area search may be performed by adjusting the distance between modules of respective life-saving robots 100. As the area formed by the cluster is increased, a large number of drowning people 500 may be searched efficiently in a short time.

In some examples, referring to FIG. 6B, a plurality of life-saving robots 100 are arranged in a single row, forming an arbitrary boundary line on the water. In this case, there is an effect of marking an area on the beach or sea level to warn of danger so that the user 600 does not approach the area where an accident occurred or a dangerous area.

In some examples, referring to FIG. 6C, a plurality of life-saving robots 100 are arranged in a circular arrangement to emphasize the target point. It is effective in focusing and ensuring safety when rescuing a drowning person or highlighting a target. In detail, the effect may be increased when used with aircraft such as helicopters or drones.

Figure 7:
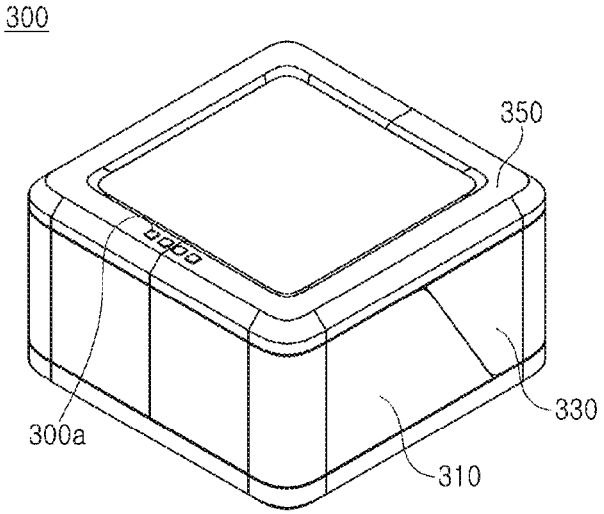
FIG. 7 is a perspective view illustrating an example of a docking station for storing and charging the life-saving robot.
Figure 8:
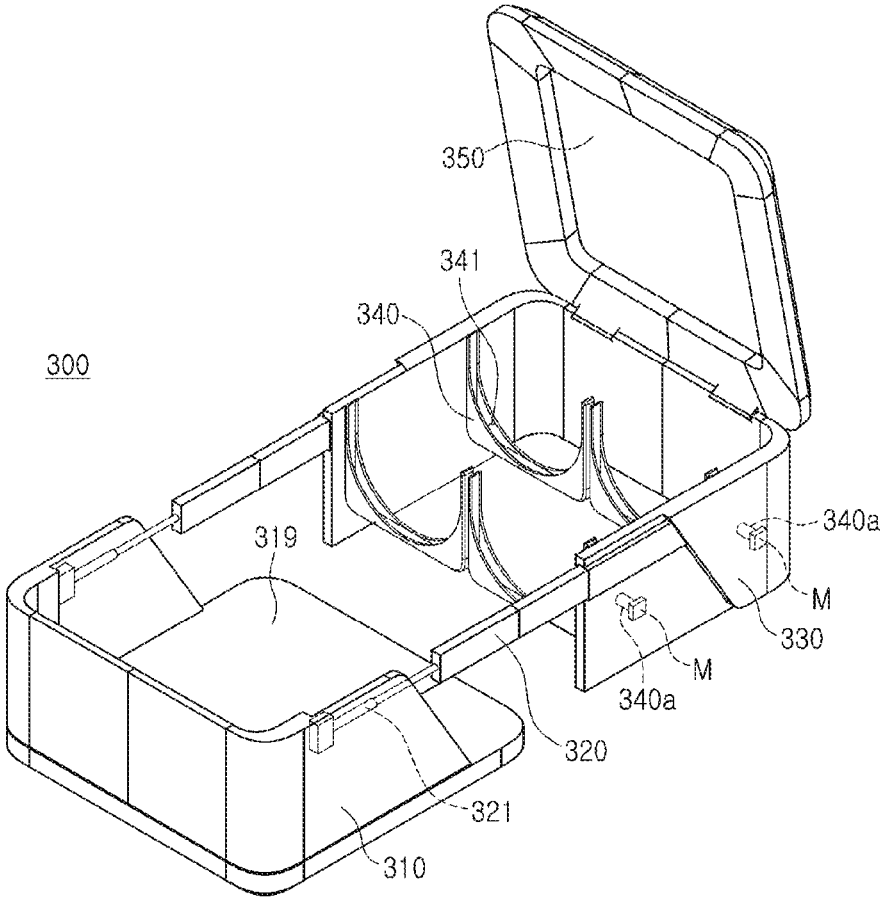
FIG. 8 is an expanded perspective view of the docking station.
Figure 9A:
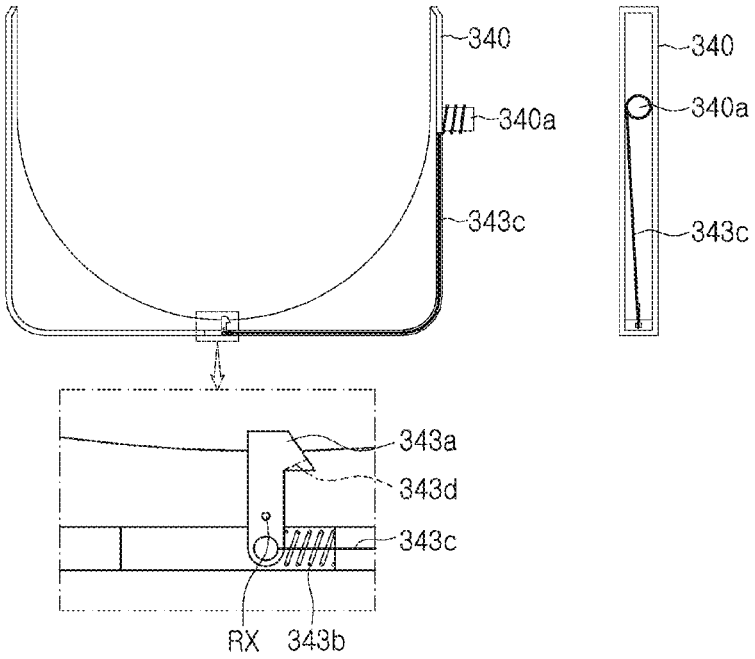
FIGS. 9A and 9B are diagrams respectively illustrating an example of the life-saving robot being fixed to the docking station and being separated therefrom.
Figure 9B:
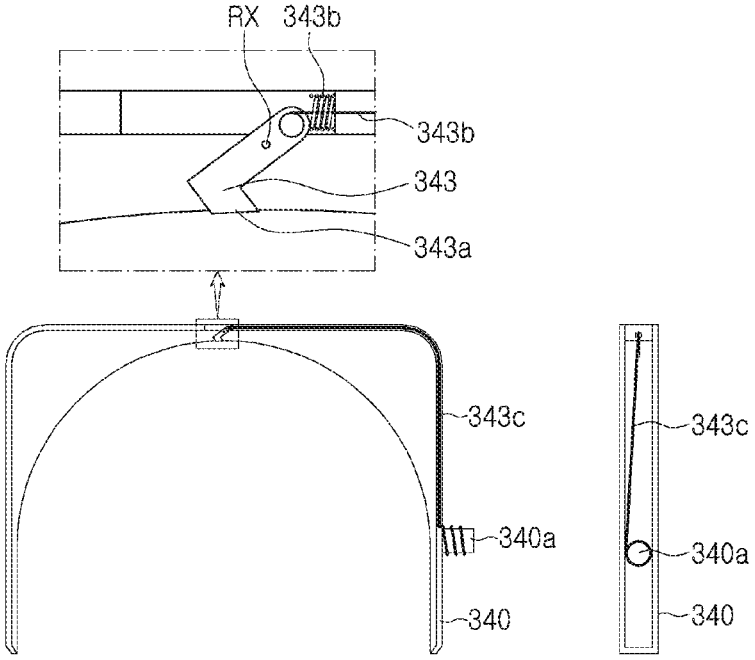
Figure 10:
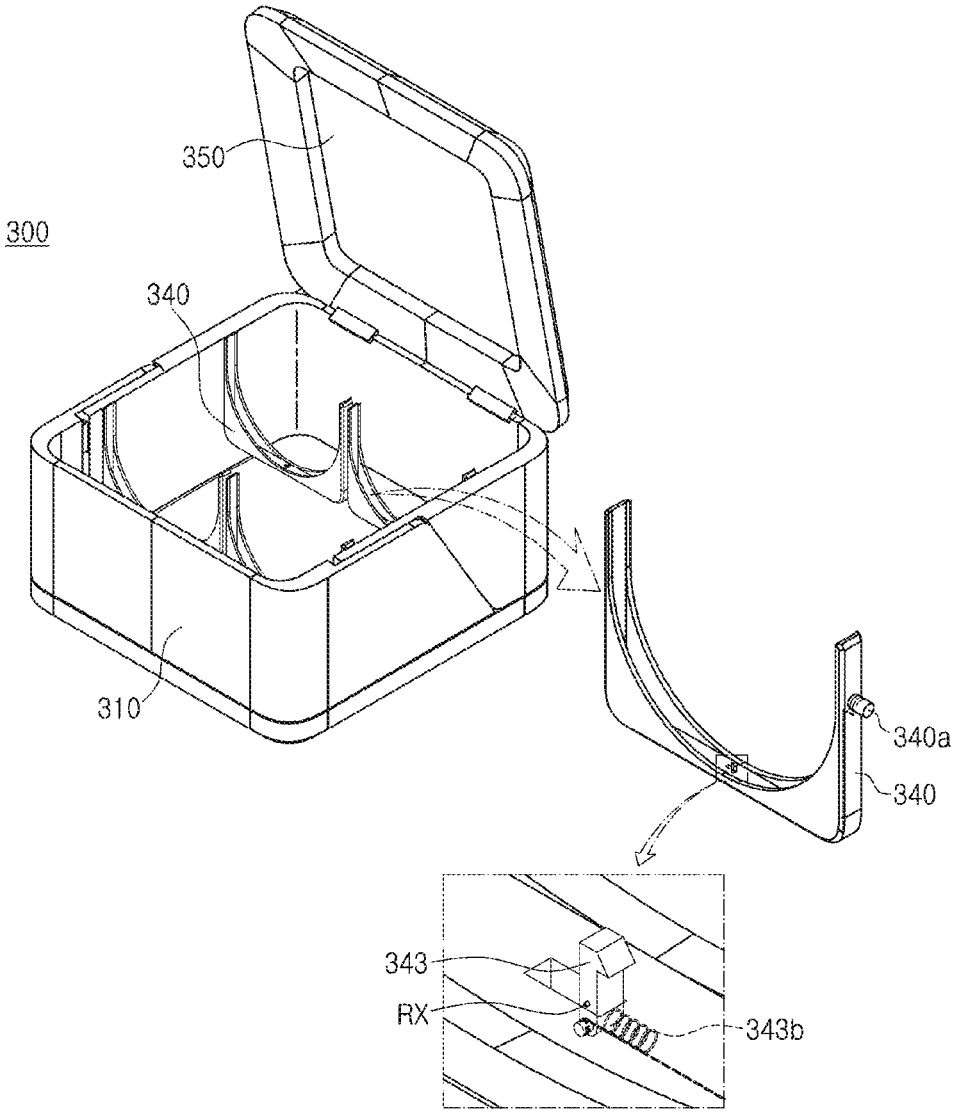
FIG. 10 is a diagram illustrating, in detail, a shape of a hollow insertion portion in which the life-saving robot is inserted into the docking portion of the docking station.

Referring to FIG. 7 and subsequent drawings, a docking station may be configured to store and charge the life-saving robot. For example, the life-saving robot 100 may have a dedicated docking station 300, and the docking station 300 may have a structure that stores and charges the life-saving robot 100 and is capable of ejecting the life-saving robot 100 in an emergency.

Referring to FIGS. 7 to 10, the docking station 300 may charge the life-saving robot 100 while storing the life-saving robot 100, and may rapidly eject the life-saving robot 100 when an emergency situation occurs.

In addition, the docking station 300 may be provided with a charging module 359 on the cover 350, and as a result, the battery 123 may be charged by interacting with the charging module 132 provided in the life-saving robot 100. A charging indicator 300*a* may be provided on the outside of the docking station 300, for example, on the cover 350.

In some implementations, the docking station 300 may include a first housing 310, a second housing 330 that is slidably coupled to the first housing 310, and a docking portion 340 provided in the second housing 330 and fixing the life-saving robot that may be stored therein. The docking portion 340 may be rotatably provided.

The docking station 300 formed by combining the first housing 310 and the second housing 330 may have a square box-shaped appearance. The first housing 310 may have a bottom plate 319, and the second housing 330 may have a cover 350 that may be opened and closed.

The second housing 330, which is slidably coupled to the first housing 310, does not have a separate bottom.

The first housing 310 may be fixedly coupled to a ship, an aircraft, or the like, and when the second housing 330 slides away from the first housing 310, the second housing 330 may be separated into a state floating in the air or with the water directly below.

In some examples, when the second housing 330 is separated by sliding from the first housing 310, the second housing 330 may be separated from the bottom. The life-saving robot 100 stored in the internal docking portion 340 may fall to the bottom and may be ejected into the water, and may be ejected and move under the control of the control unit 117.

The first housing 310 may be combined with the second housing 330 to form an entire housing. The first housing 310 may include a side wall and a bottom plate 319. The first housing 310 may be connected to the second housing 330 and a sliding rail 320.

The sliding rail 320 may be extended or reduced in length by the hydraulic cylinder 321, and thereby the first housing 310 and the second housing 33 may be slidably coupled to each other or separated from each other.

In some examples, as shown in the drawing, the hydraulic cylinder 321 is illustrated as being provided in the first housing 310. In some examples, the hydraulic cylinder 321 may be provided in any of the first housing 310 or the second housing 330, and may also be provided inside the sliding rail 320.

A docking portion 340 may be rotatably provided in the second housing 330. The docking portion 340 may be provided with a hollow insertion portion 341 to accommodate the life-saving robot 100, and may be provided with a fixing hook 342 to secure the stored life-saving robot 100.

There may be at least one docking portion 340, and to increase usability, the docking portion 340 may be provided in a number corresponding to the square of a natural number, such as 2*2=4, 3*3=9, or the like.

The hollow insertion portion 341 may be provided in a holder shape approximately corresponding to the thickness of the handle 111 so that the handle 111 of the life-saving robot 100 is inserted.

A fixed hook groove 110*d* may be provided on the edge of the housing 110 of the life-saving robot 100, and the docking portion 340 may be provided with a fixing hook 343, and after the life-saving robot 100 is stored in the docking portion 340, the fixing hook 343 may be fixed by being inserted into the fixing hook groove 110*d*.

At least one fixed hook groove (110*d*) may be provided on the edge of the housing 110 of the life-saving robot 100, and for convenience of storage of the life-saving robot 100, four units may be provided at 90-degree intervals along the edge of the housing 110 to enable storage without considering directionality.

In the case of the fixing hook 343 of the docking portion 340, when the life-saving robot 100 is inserted into the hollow insertion portion 341 of the docking portion 340, the support spring 343*b* that pushes the fixing hook 343 is pushed, and the fixing hook 343 is pushed and then returns to be caught in the fixing hook groove 110*d*, and thereby the life-saving robot 100 may be fixed to the docking portion 340.

In addition, the fixing hook 343 may be connected to the wire 343*c*, and the wire 343*c* is connected to the rotating shaft 340*a* of the docking portion 340, so that when the rotating shaft 340*a* rotates, the wire 343*c* is wound around the rotating shaft 340*a* and is pulled to push the fixing hook 343. As a result, the life-saving robot 100 may be provided with a structure in which it is automatically separated from the docking portion 340.

In some implementations, the fixing hook 343 of the docking portion 340 may be linked to a separate drive motor so that the fixing hook 343 is pushed or returned to an original state thereof.

The docking portion 340 is rotatable, so that when the cover 350 is opened or closed to insert the life-saving robot 100, the docking portion 340 may also be rotated. For this purpose, a rotation motor (M) may be linked to the rotation shaft 340*a* of the docking portion 340. For example, the rotation shaft 340*a* of the docking portion 340 may be provided to be rotated by the rotation of the rotation motor (M). A predetermined gearbox may be provided between the rotation shaft 340*a* and the rotation motor (M).

Figure 11:
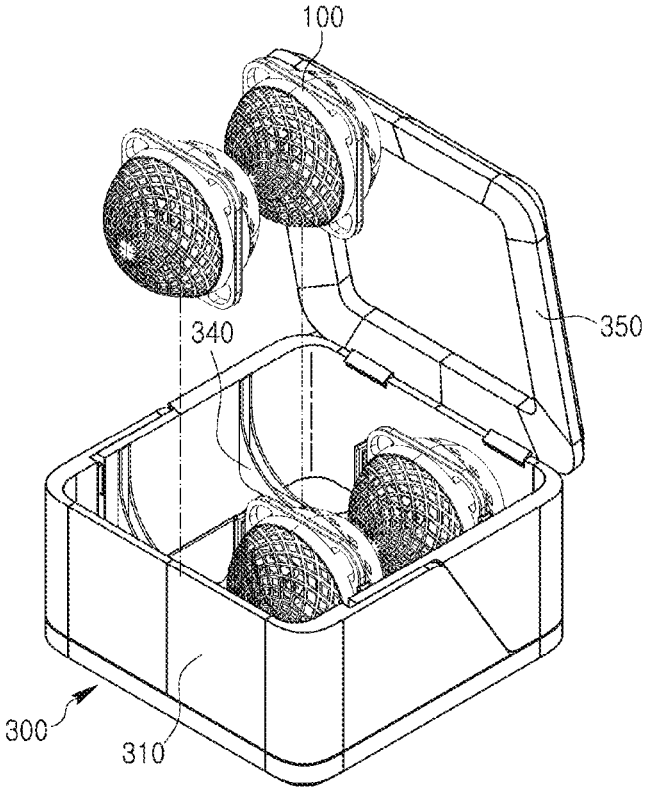
FIG. 11 is a diagram illustrating an example of a process of storing the life-saving robot in the docking station.
Figure 14:
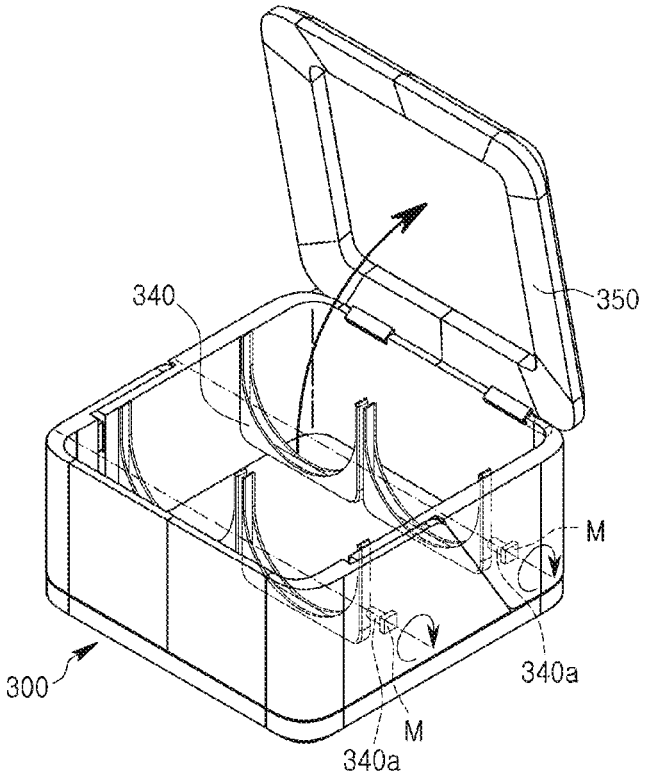
FIG. 14 is a diagram illustrating the docking portion rotating together when a cover of the docking station is opened.

In some implementations, referring to FIGS. 11 and 14, when the cover 350 of the second housing 330 is opened, the controller recognizes the opening by a detection sensor and drives the rotation motor (M). Thereby, the docking portion 340 may be rotated so that the hollow insertion portion 341 of the docking portion 340 faces upward, and accordingly, the life-saving robot 100 may be easily inserted into the docking portion 340.

A variety of detection sensors may be used, such as distance sensors, magnetic sensors, and contact sensors.

In some implementations, in the case of the fixing hook 343 of the docking portion 340, when the life-saving robot 100 is inserted into the hollow insertion portion 341 of the docking portion 340, the support spring 343*b* is pushed and the fixing hook 343 is pushed and then returns to be caught in the fixing hook groove 110*d*. As a result, the life-saving robot 100 may be fixed to the docking portion 340.

Figure 12:
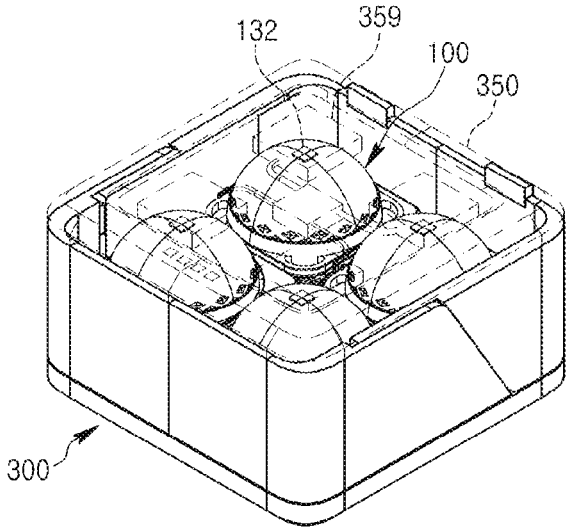
FIG. 12 is a diagram illustrating a state in which the life-saving robot is stored in a docking station.
Figure 15:
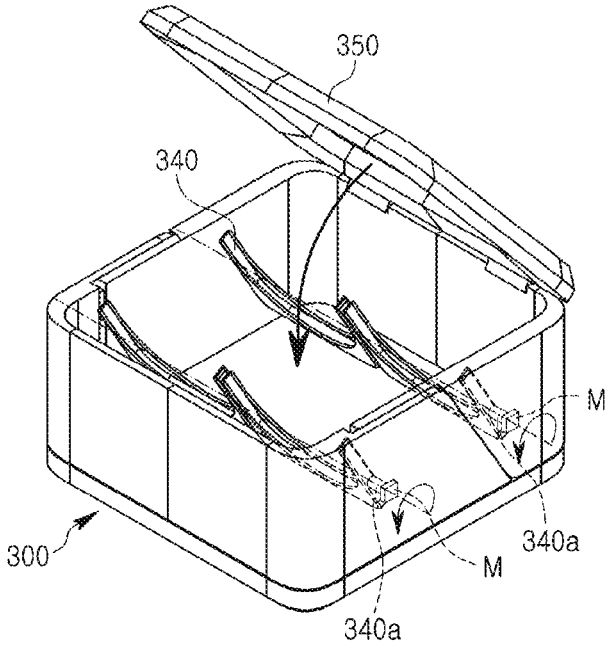
FIG. 15 is a diagram illustrating the docking portion rotating together when the cover of the docking station is closed.

In some implementations, referring to FIGS. 12 and 15, when the cover 350 of the second housing 330 is closed, the controller recognizes this closing by the detection sensor and drives the rotation motor M. Therefore, the docking portion 340 may be rotated in such a manner that the hollow insertion portion 341 of the docking portion 340 faces the side and the upper hemisphere of the life-saving robot 100 stored in the docking portion 340 faces the upper cover 350. Accordingly, the upper hemisphere of the life-saving robot 100 may be aligned to face the inner surface of the cover 350. A variety of detection sensors may be used, such as distance sensors, magnetic sensors, and contact sensors.

The charging module 132 provided at the end of the upper hemisphere of the life-saving robot 100 and the charging module 359 provided on the cover 350 interact to charge the battery 123 of the life-saving robot 100. The charging modules 132 and 359 may be wired or wireless charging modules.

Figure 13:
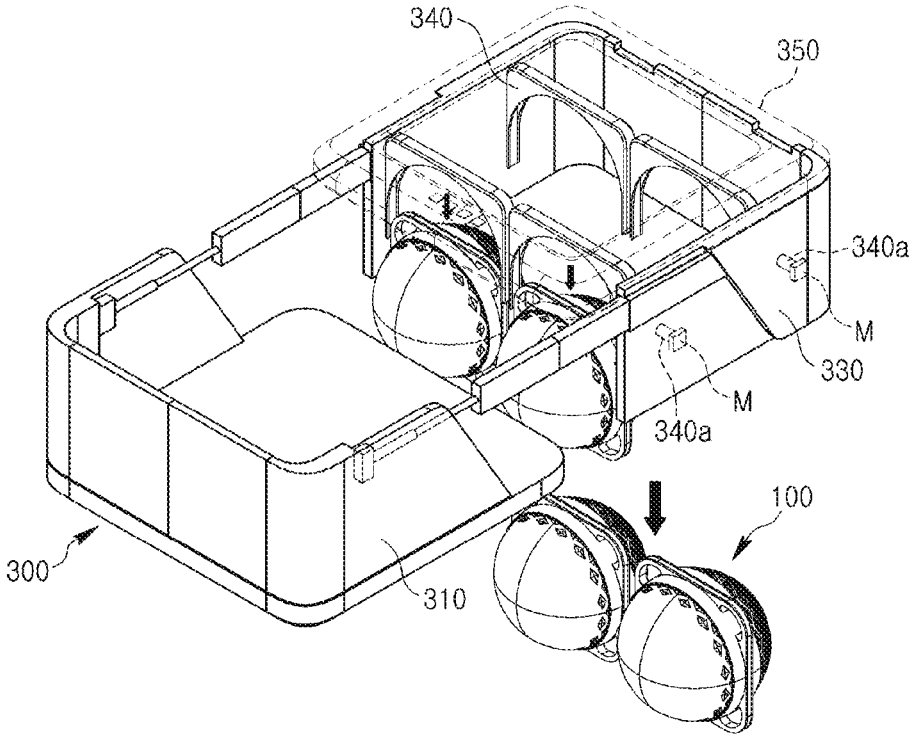
FIG. 13 is a diagram illustrating ejection of the life-saving robot stored in the docking station.
Figure 16:
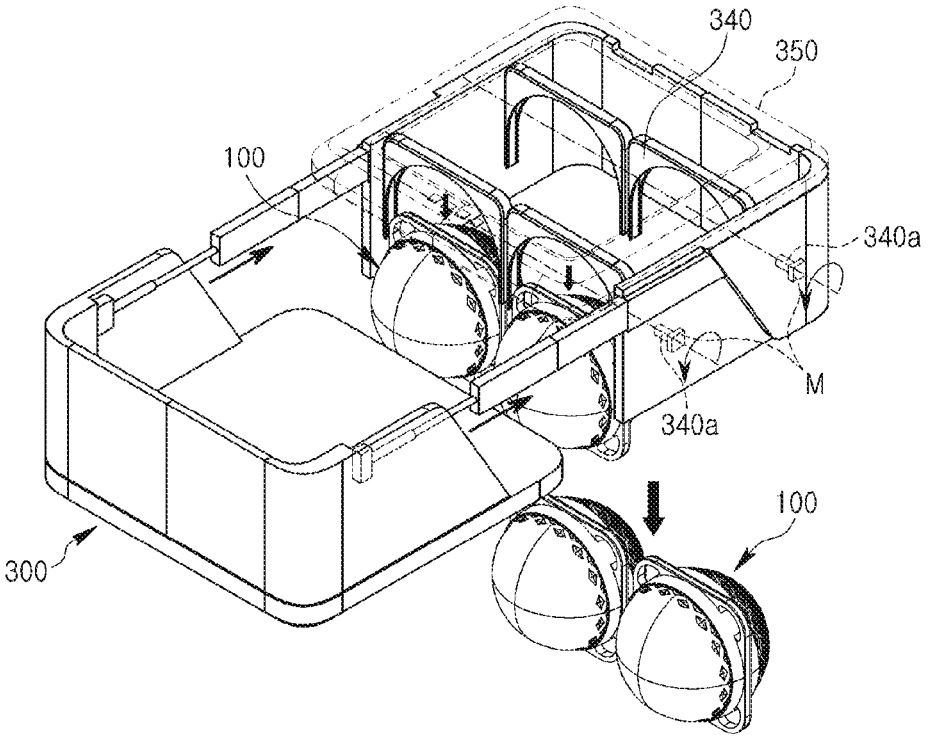
FIG. 16 is a diagram illustrating an example where a second housing is opened by sliding on a first housing in the docking station, the docking portion rotates together with the life-saving robot, and the life-saving robot is ejected from the docking station.

In some implementations, referring to FIGS. 13 and 16, when the second housing 330 is separated by sliding from the first housing 310 by operation of a controller or manually, the second housing 330 may be separated without a bottom, and the life-saving robot 100 stored in the internal docking portion 340 may fall to the bottom and may be ejected into the water, and move by being ejected under the control of the control unit 117.

The sliding rail 320 may be extended or reduced in length by the hydraulic cylinder 321, and thereby the first housing 310 and the second housing 33 may be slidably coupled to each other or separated from each other.

When the second housing 330 slides away from the first housing 310, the controller recognizes this by a detection sensor and drives the rotation motor (M). The hollow insertion portion 341 of the docking portion 340 may be rotated to face downward and the upper hemisphere of the life-saving robot 100 stored in the docking portion 340 may be rotated to face downward. A variety of detection sensors may be used, such as distance sensors, magnetic sensors, and contact sensors.

In addition, the fixing hook 343 may be connected to the wire 343*c*, and the wire 343*c* is connected to the rotating shaft 340*a* of the docking portion 340, so that when the rotating shaft 340*a* rotates, the wire 343*c* is wound around the rotating shaft 340*a* and is pulled to push the fixing hook 343. As a result, the life-saving robot 100 may be automatically separated from the docking portion 340.

Accordingly, the life-saving robot 100 stored in the docking portion 340 may fall to the bottom and may be ejected into the water, and may move by being ejected under the control of the control unit 117.

As set forth above, a life-saving robot according to some embodiments may have a simple structure and may be not only easy to store and charge, but also has a structure that may be ejected rapidly in emergency situations.

In some implementations, a life-saving robot may have a dedicated docking station. For example, the docking station may have a structure storing and charging the life-saving robot and is capable of ejecting the life-saving robot in an emergency.

While example embodiments have been illustrated and described above, it will be apparent to those skilled in the art that modifications and variations could be made without departing from the scope of the present disclosure as defined by the appended claims.

What is claimed is:

1. An apparatus comprising:

a housing having a round ring shape;

a buoyancy generator disposed at an upper portion of the housing and configured to provide buoyancy force;

a thrust generator disposed at a lower portion of the housing and configured to provide propulsive force;

a driver configured to provide power to the thrust generator; and a guard portion that is disposed at the lower portion of the housing and covers the thrust generator, wherein an exterior of the apparatus is substantially spherical and defined by a combination of the buoyancy generator, the housing, and the guard portion.

2. The apparatus of claim 1, wherein the housing comprises a handle that protrudes externally.

3. The apparatus of claim 2, wherein the housing has a square shape having rounded corners, and wherein the handle is disposed at at least one of the rounded corners along an edge of the housing.

4. The apparatus of claim 1, wherein the buoyancy generator comprises an air capsule disposed therein, wherein a shape of the air capsule corresponds to a shape of the buoyancy generator.

5. The apparatus of claim 4, wherein the buoyancy generator is coupled to the housing and defines a watertight space between the buoyancy generator and the housing.

6. The apparatus of claim 4, wherein the buoyancy generator further comprises an upper cover that is in contact with an outer surface of the air capsule and defines an upper part of the exterior of the apparatus.

7. The apparatus of claim 1, wherein the driver comprises:

a driving motor configured to drive the thrust generator; and a battery configured to provide power to the driving motor.

8. The apparatus of claim 7, wherein the thrust generator comprises a propeller.

9. The apparatus of claim 7, wherein the buoyancy generator comprises a charging module connected to the battery.

10. The apparatus of claim 1, wherein the guard portion comprises a mesh-shaped frame.

11. The apparatus of claim 1, further comprising a communication interface and a Global Positioning System (GPS) that are disposed at the housing.

12. The apparatus of claim 1, wherein the buoyancy generator has a hemispherical shape and is coupled to the upper portion of the housing, and wherein the guard portion has a hemispherical shape and is coupled to the lower portion of the housing.

13. The apparatus of claim 12, wherein the housing is disposed between the buoyancy generator and the guard portion and surrounds a circumference of each of the buoyancy generator and the guard portion.

14. The apparatus of claim 12, wherein the housing has a square shape having rounded corners, and wherein the housing comprises a plurality of handles that are disposed the rounded corners, respectively, and protrude radially outward relative to the circumference of each of the buoyancy generator and the guard portion.

15. The apparatus of claim 11, wherein the guard portion defines a plurality holes configured to communicate water.

16. A system comprising:

a plurality of apparatuses including the apparatus of claim 1.

17. The system of claim 16, wherein the plurality of apparatuses are configured to form a plurality of patterns.

18. The system of claim 16, further comprising a docking station configured to accommodate the plurality of apparatuses.

19. The system of claim 18, wherein the docking station comprises a plurality of docking portions that are configured to couple to the housings of the plurality of apparatuses, respectively.

20. The system of claim 19, wherein the plurality of docking portions are configured to rotate the plurality of apparatuses to thereby eject the plurality of apparatuses to an outside of the docking station.

* * * * *